US008115123B2

(12) United States Patent
Singh et al.

(10) Patent No.: US 8,115,123 B2
(45) Date of Patent: Feb. 14, 2012

(54) CONFIGURABLE CIRCUIT BREAKER

(75) Inventors: Shailendra Singh, Maharashtra (IN); Subbiahthever Dukkaiappan, Maharashtra (IN)

(73) Assignee: ABB Technology Ltd, Zurich (CH)

( * ) Notice: Subject to any disclaimer, the term of this patent is extended or adjusted under 35 U.S.C. 154(b) by 0 days.

(21) Appl. No.: 12/856,707

(22) Filed: Aug. 16, 2010

(65) Prior Publication Data

US 2011/0013345 A1 Jan. 20, 2011

Related U.S. Application Data

(63) Continuation of application No. PCT/IB2008/000440, filed on Feb. 15, 2008.

(51) Int. Cl.
*H01H 9/00* (2006.01)

(52) U.S. Cl. ..... 200/50.21; 200/50.27; 218/118; 218/154; 218/157; 361/605

(58) Field of Classification Search .... 200/50.21–50.24, 200/50.27; 218/1–7, 152–155; 361/600–602, 361/605–611, 614, 615, 617, 622, 624, 625, 361/627–629, 631–641, 643–645, 647–658
See application file for complete search history.

(56) References Cited

U.S. PATENT DOCUMENTS

| | | | | |
|---|---|---|---|---|
| 3,823,281 | A * | 7/1974 | Wilson | 200/50.24 |
| 3,899,722 | A | 8/1975 | Cadez et al. | |
| 3,958,093 | A * | 5/1976 | Cleaveland | 218/118 |
| 3,973,096 | A * | 8/1976 | Burgoon | 218/118 |
| 4,449,021 | A * | 5/1984 | Wakayama et al. | 218/119 |
| 4,950,854 | A | 8/1990 | Green | |
| 5,532,432 | A * | 7/1996 | Ishikawa | 174/60 |
| 5,566,818 | A | 10/1996 | Kuboyama et al. | |
| 5,929,410 | A * | 7/1999 | Mun | 218/121 |
| 6,337,613 | B1 | 1/2002 | Grelier et al. | |
| 6,462,296 | B1 | 10/2002 | Boettcher et al. | |
| 7,075,021 | B2 * | 7/2006 | Rowe et al. | 200/50.21 |
| 7,187,258 | B2 | 3/2007 | Yamazaki et al. | |
| 7,544,907 | B1 * | 6/2009 | Moffat et al. | 200/50.21 |
| 2007/0159776 | A1 | 7/2007 | McCoy et al. | |
| 2010/0208416 | A1 * | 8/2010 | Shoda et al. | 361/606 |

FOREIGN PATENT DOCUMENTS

| | | |
|---|---|---|
| EP | 1 775 744 A2 | 4/2007 |
| GB | 1 474 805 A | 5/1977 |
| WO | WO 98/07223 A1 | 2/1998 |

OTHER PUBLICATIONS

International Search Report (PCT/ISA/210) issued on Jul. 1, 2009 for International Application No. PCT/IB2008/000440.

* cited by examiner

*Primary Examiner* — Michael Friedhofer
(74) *Attorney, Agent, or Firm* — Buchanan Ingersoll & Rooney PC

(57) ABSTRACT

A configurable circuit breaker is disclosed which is, for example, applicable for medium voltage range, with flexibility in configuration, based on the electrical and mechanical constraints. The circuit breaker can include multiple poles, which can be fitted on a shaft at desired positions, using clamping, dowelling, bolting or other types of connections. An epoxy frame can mount the circuit breaker on a truck horizontally or vertically, by mounting inserts and the clamping mechanism. Side sheets of the pole allow internal access. Flexible contacts and the vertical slots enable adjustability in the incoming and outgoing distances, as per design constraints. A tulip contact can be provided for mounting incoming/outgoing conductors. A common actuator can be mounted anywhere on the shaft, via the movable contact or on any of the poles, which are robust enough.

16 Claims, 7 Drawing Sheets

CONFIGURABLE CIRCUIT BREAKER

RELATED APPLICATION

This application claims priority as a continuation application under 35 U.S.C. §120 to PCT/IB2008/000440 filed as an International Application on Feb. 15, 2008 designating the U.S., the entire content of which is hereby incorporated by reference in its entirety

FIELD

This disclosure relates to a configurable circuit breaker, which can be used or retrofit to different panels, with a variable set of design parameters enabling the same.

BACKGROUND INFORMATION

Circuit breakers are switches used to protect circuitry from damage due to overload, by their automatic operation. They come in various sizes and voltage/current capacities and are selected for use, according to specifications. A key operation is termed actuator mechanism, which may be magnetic, thermal or thermo magnetic. The actuator holds the contactor in place for normal operation and moves apart the contactors in case of overload. The contactor allows the current flow when closed and blocks the current when open, thus protecting the circuit in question from damaging levels of voltage/current.

Circuit breakers that are available in the market today do not have the flexibility to adapt to a variety of panel specifications. In the circuit breakers which do aim at providing a retrofit solution for various panels, an existing breaker (VD4, Vmax) is used and further adapted to panel specifications. This can introduce a need for custom made connections, such as those manufactured using epoxy cast copper for routing the current, which can lead to increased cost and design time. Another challenge, which presents itself, is that some of the panels are not spatially oriented to enclose existing circuit breakers. This can pose a limitation in using pre-existing circuit breakers, which are both inflexible and expensive, leading to custom manufacture of circuit breakers to fit different panel specifications.

U.S. Pat. No. 6,462,296 provides movement of an entire circuit breaker (in and out), much like a current rack arrangement The number of modules has an upper limit.

US Patent Publication No. 20070159776 discloses a circuit breaker mounting plate having a prong adapted to receive a clip.

U.S. Pat. No. 5,566,818 relates to a movable contactor device in a circuit breaker such as a wiring breaker or earth leakage breaker. In this US patent, two contactor elements made up of flat conductors are arranged in such a manner that the contactor elements are in parallel with each other and are independent of each other to form a movable contactor for each phase. A contactor connects the conductor with the circuit breaker.

U.S. Pat. No. 6,337,613 discloses a three-phase, high-current switchgear apparatus with or without neutral having pole compartments connected in parallel. Distribution of current and temperatures between the twinned poles of 3-phase switchgear apparatus and circuit breaker are addressed.

EP1775744 discloses a method for the preparation of a three pole circuit-breaker. The three pole power switch has a switch lock where each pole has its own rapid short circuit trip to act on a trip shaft.

U.S. Pat. No. 7,187,258 discloses a circuit breaker such as a molded case circuit breaker or an earth leakage breaker having a movable contact opened by an electromagnetic repulsive force when a large current such as a short-circuit current flows. This patent is directed to utilizing electromagnetic force for operation. A protection cover is made of an insulating material that covers a movable contact to extinguish a contact arc generated when the contact opens.

U.S. Pat. No. 4,950,854 discloses replacement of older air-magnetic circuit breaker by vacuum operated circuit breaker without modifications in the cubicle.

U.S. Pat. No. 3,973,096 provides minor adjustability for primary contacts for roll-in-type switchgear units.

Current circuit breakers, which try to accommodate different sized panels, do so by modifying the end-connections to fit the panel. Such circuit breakers are subject to space constraints, inability to fit into panels with different bushing designs, being immovable or fixed in one place, and so forth.

The entire disclosures of all the foregoing documents are hereby incorporated by reference in their entireties.

SUMMARY

A configurable circuit breaker is disclosed which is adaptable to any of plural structural setups and includes three independent poles, each pole comprising an interconnection of: an incoming conductive point and an outgoing conductive point; at least one vertical slot; a clamp for mounting the circuit breaker; at least one mounting insert connected with the clamp; a movable link for actuation of the circuit breaker; a side panel; an epoxy frame for mounting the circuit breaker on a cassette or truck horizontally or vertically; and at least one conducting stub configured to fit a tulip contact.

DETAILED DESCRIPTION

Exemplary embodiments of the present disclosure consider configurations, mountings and casings of circuit breakers of various models. As disclosed herein, a flexible configuration circuit breaker includes an overall size which can be modified as per variations in the parts thereof, and which can be positioned within a custom configured framework as per constraints such as electric/magnetic isolation, and space.

A flexible circuit breaker as disclosed herein can be easily retrofit into existing panels or used in new panels. Known solutions have fixed pole distances, involving routing components for the panel. This can introduce constraints on the space specifications. An exemplary circuit breaker can be provided with or without independent poles, which can be configured. A configurable circuit breaker of the present disclosure can have a variable distance between its poles, in order to accommodate a variety of panel sizes. An exemplary circuit breaker of the present disclosure can include movable incoming and outgoing arms, which can be moved to suit a variety of panel bushing designs on different panels. Moreover it can be used in horizontal or vertical configuration A configurable circuit breaker as disclosed herein can be used in new panels or retrofit on a variety of different panels. The circuit breaker of the present disclosure can work on a medium voltage range, between 3.3 kV to 40 kV including normal and short-circuit current ranging from 200 A to 6300 A and 20 kA to 63 kA, respectively. The present disclosure can reduce the complexity introduced by a fixed distance among the poles and incoming-outgoing contact arms by providing a flexible, adaptable configuration.

Figure 1:
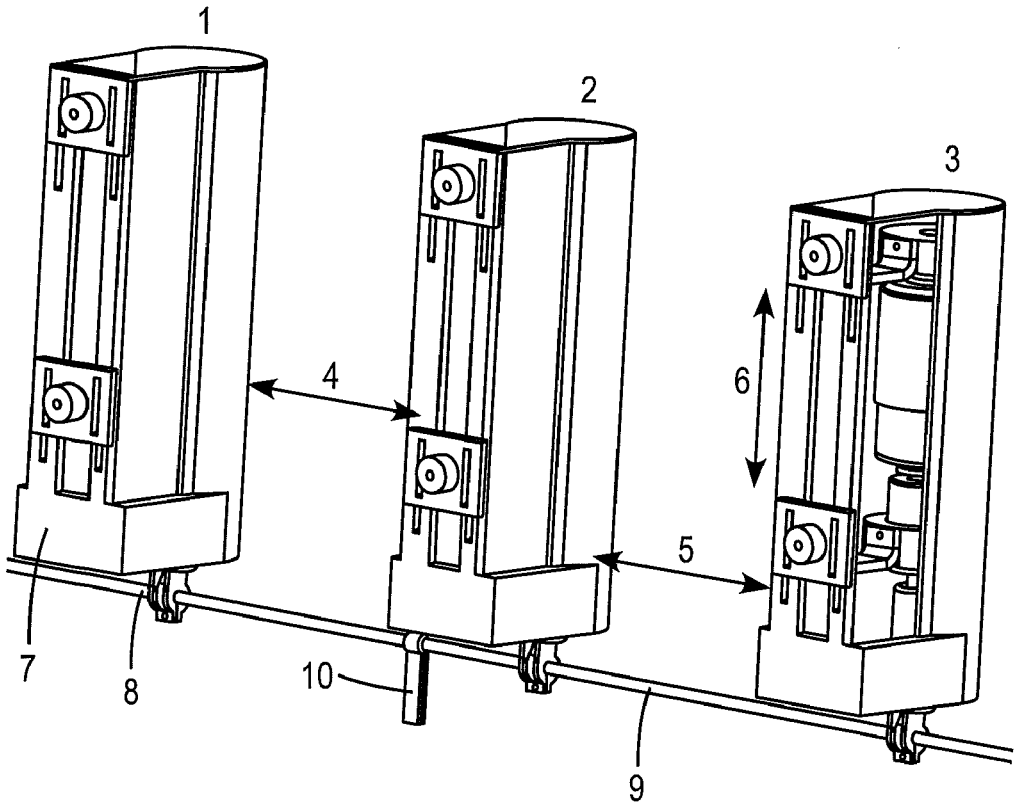
FIG. 1 shows three individual poles with variable phase distance in accordance with an exemplary embodiment of the present disclosure.

FIG. 1 shows three individual poles in an exemplary embodiment of the present disclosure with variable phase distance. Each of the poles 1, 2, 3 is clamped on the shaft 9 via a clamp 8. The position of the clamp is adjustable, in turn, making the pole distance variable as per a specification. This enables managing the space and isolation constraints.

An epoxy frame 7 can be used to mount the breaker either horizontally or vertically on a cassette or truck directly. A movable link 10 is provided for connecting the linkage of the circuit breaker to the common shaft. The circuit breaker has an adjustable arm distance 6 and an adjustable pole distance 4, 5 rendering a flexible design, which can cater to a variety of panel parameters. Additionally, a frameless breaker can be used.

Figure 2A:
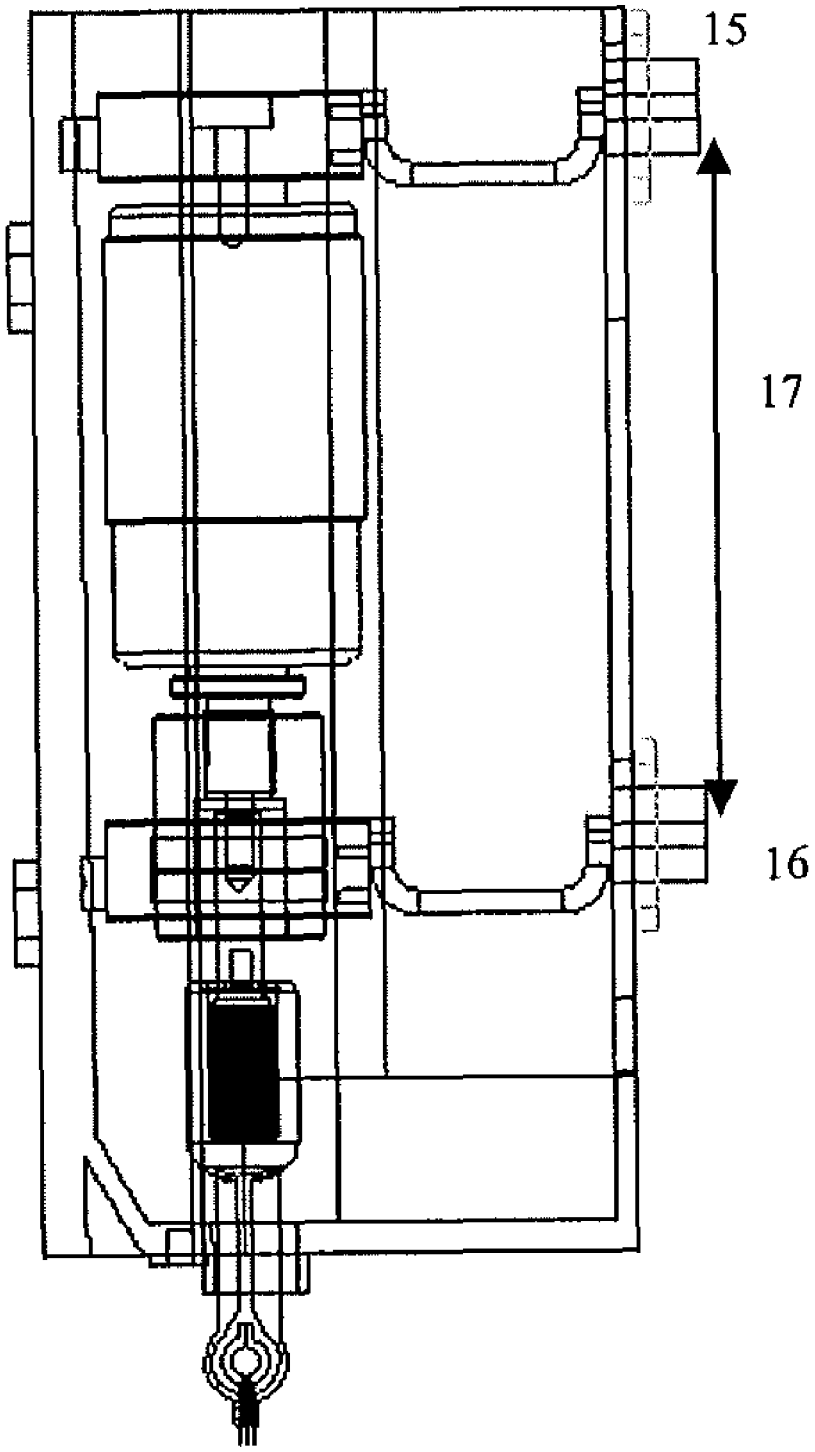
FIG. 2*a* shows exemplary adjustability of incoming and outgoing distances.

FIG. 2*a* shows flexibility in arm distance. The contacts 15 and 16 are movable, hence allowing the arm distance 17 to be adjustable.

Figure 2B:
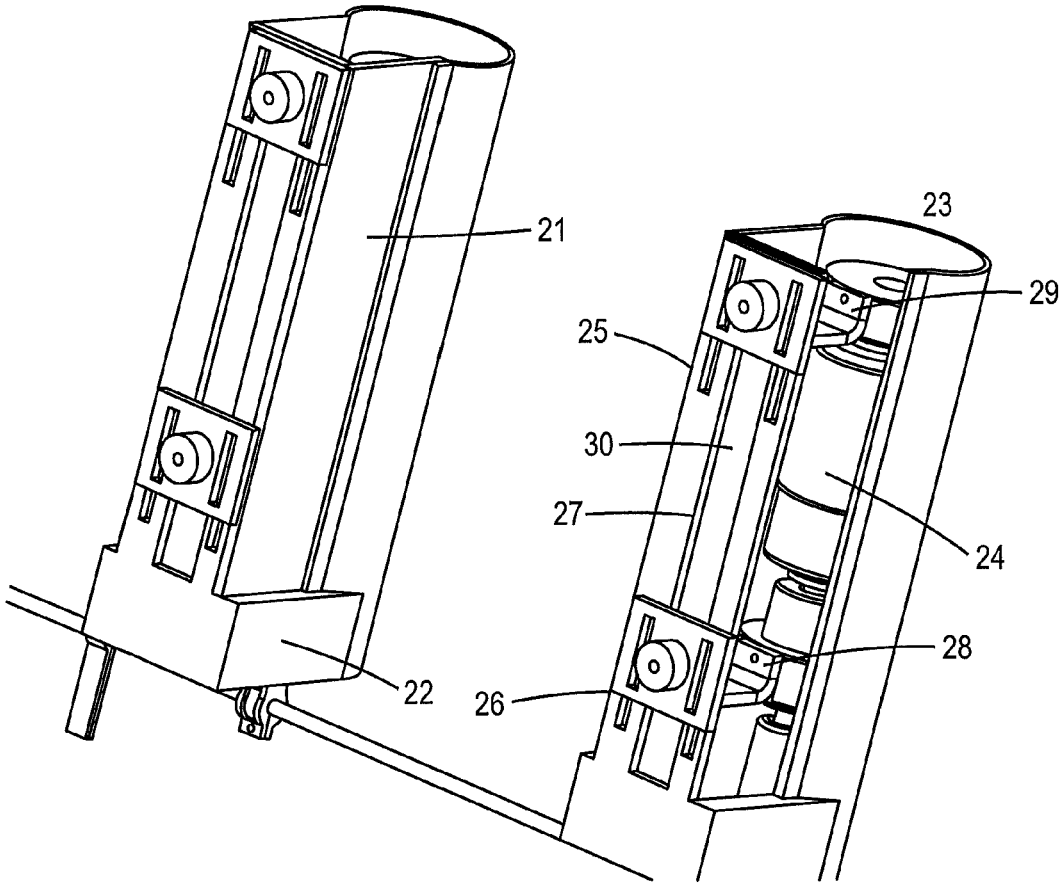
FIG. 2*b* shows an exemplary mechanism for adjusting of the incoming and outgoing distances.

FIG. 2*b*, shows an exemplary mechanism for achieving this flexibility. A side panel or sheet 21 can be fixed by means of bolts or other suitable structure, onto the epoxy frame 22 to allow access for movement. The circuit breaker 23 shows the apparatus with the side sheet removed 24 and with slots 25, 26, 27 for vertical adjustment. When side sheet is removed 24, the flexible contacts 28, 29 which connect the arms to the pole assembly are visible. Hence, arms can move vertically to suit a desired specification. The vertical slots 25, 26, 27 provide flexibility of motion. Further, since the pole to pole distances are larger in a retrofit panel, the chances of dielectric failure can be vastly reduced. Alternatively, the slots can be fitted with flexible rubber drape 30. Since many older panels have low normal rated current, a rise in temperature seldom causes a problem in exemplary circuit breakers of the present disclosure.

Figure 3:
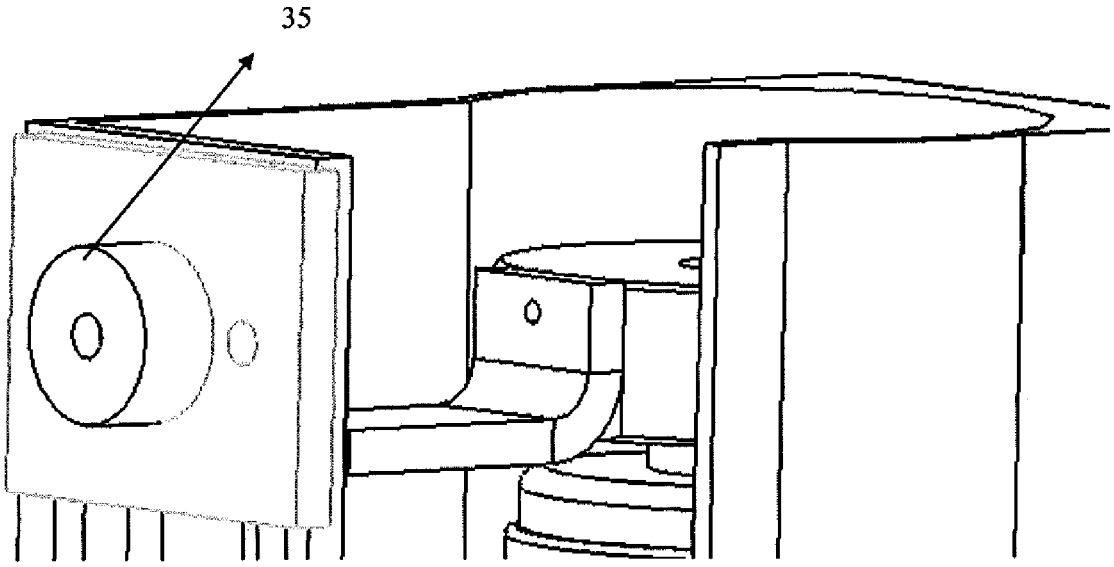
FIG. 3 focuses a connecting stub for a contactor.

FIG. 3 shows a the conducting stub for the contactor. The conducting stub 35 at the end can be a copper or an aluminum block with threading. It is used to fit in a tulip contact of the panel, which in turn, can be sleeved.

Figure 4:
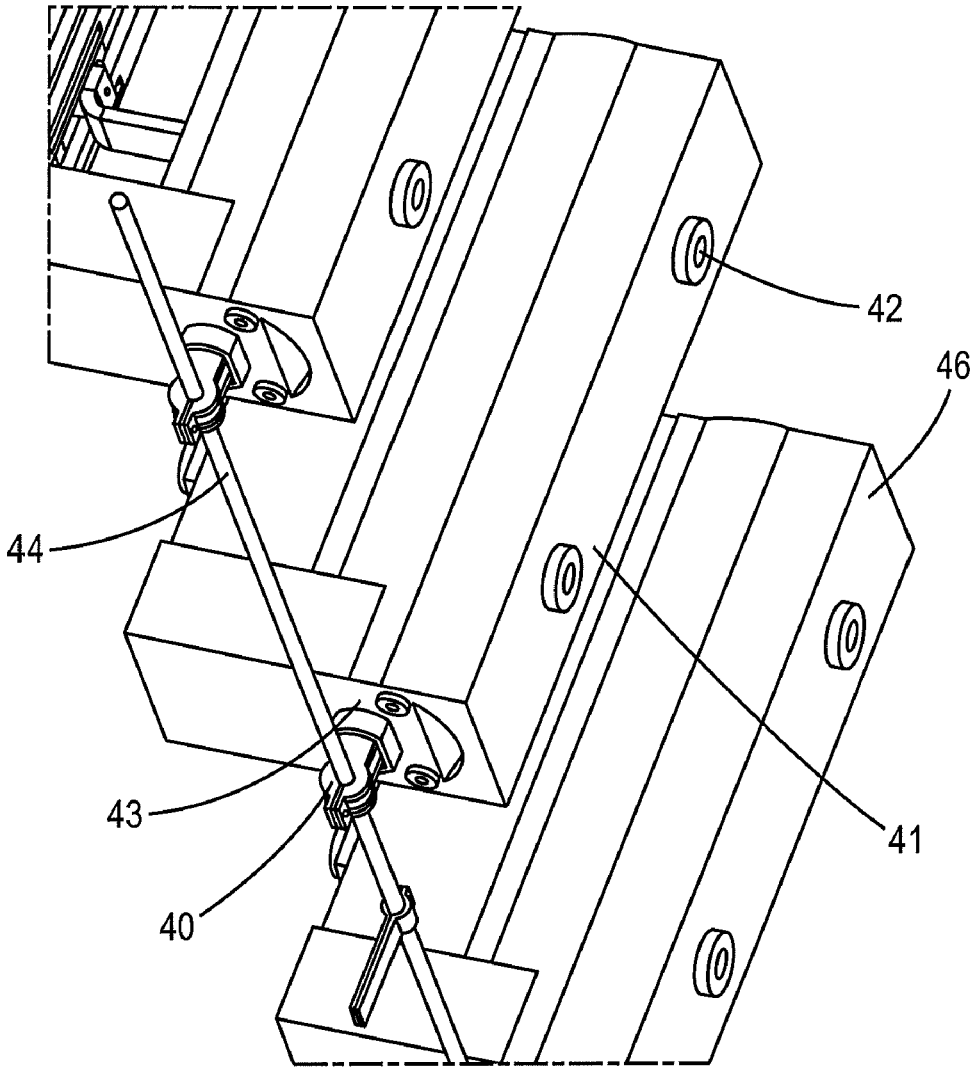
FIG. 4 shows different exemplary mounting mechanisms for horizontal and vertical mounting.

FIG. 4 shows exemplary mounting mechanisms for horizontal or vertical mounting. The mounting arrangement can be configured based on the truck design. The mounting mechanisms can include clamping mechanism 40 for clamping the circuit breaker 46 onto the shaft with a bolt, grub, screw or any other arrangement. There are inserts on the pole for fastening it with the truck structure. If the support is horizontal/vertical, the orientation of the breaker can change accordingly. In FIG. 4, the mounting inserts 41 and 42 enable horizontal clamping on the shaft 44 via the clamp 40 and the mounting insert 43 is provided to allow vertical clamping.

Figure 5:
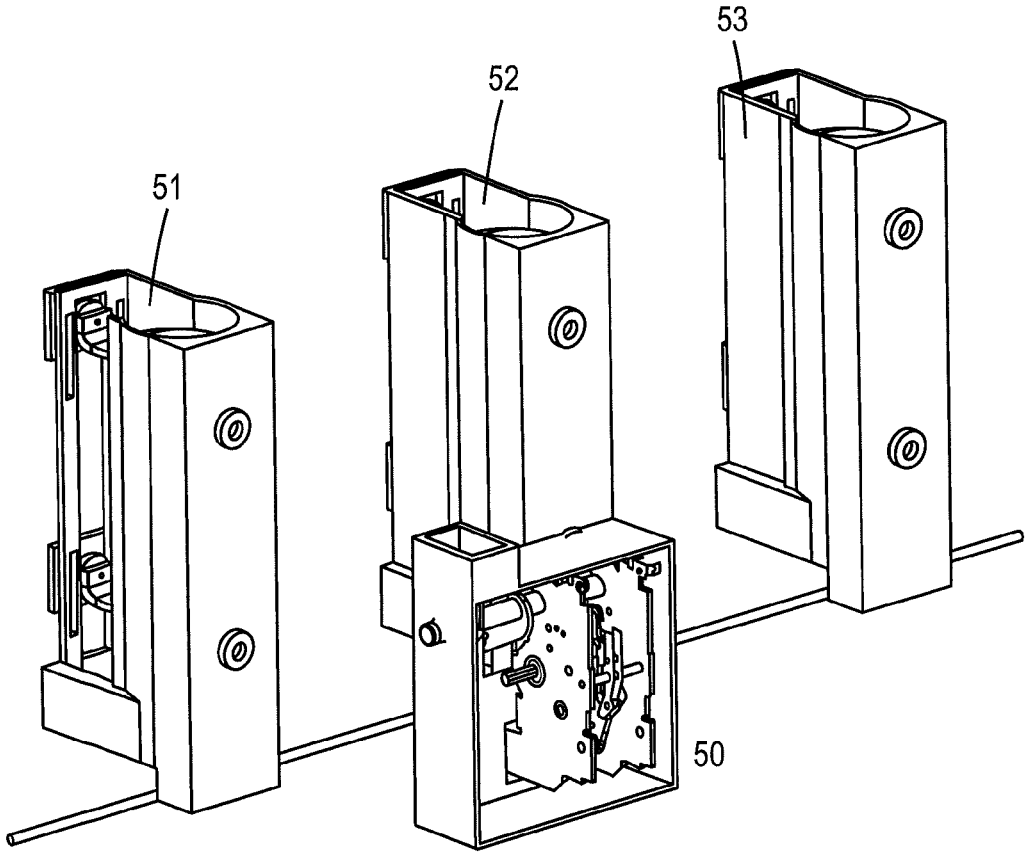
FIG. 5 shows exemplary placement of an EL drive.

FIG. 5 shows exemplary placement of an EL drive 50 on central pole 52. It can be similarly mounted on the other poles 51 or 53.

Figure 6:
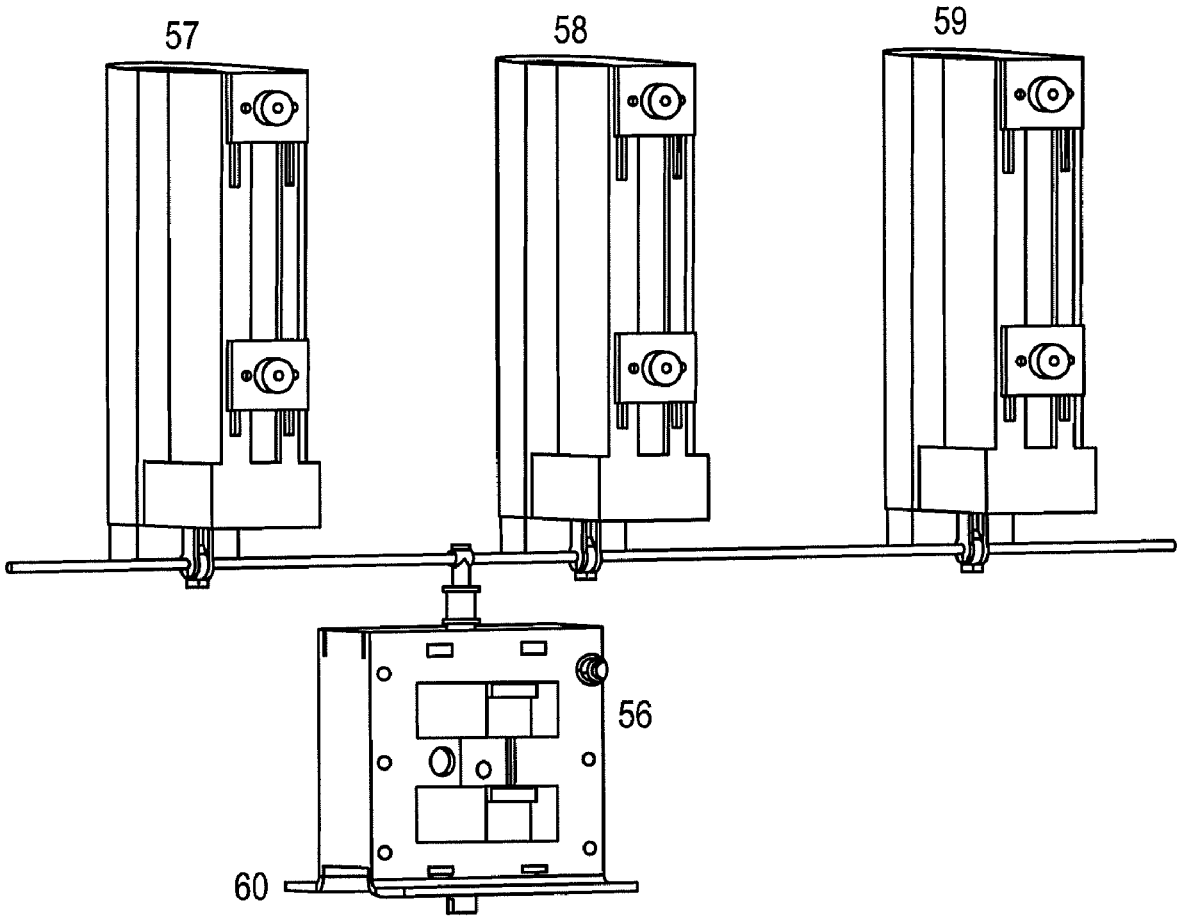
FIG. 6 shows an exemplary configuration for magnetic and single coil actuators.

FIG. 6 shows an exemplary configuration for magnetic and single coil actuators. A common magnetic/spring actuator 56 can be mounted on any of the of the pole frames 57, 58, 59 or the truck/cassette 60, as per the space specifications wherein the pole frame is strong enough to bear the load of the actuator.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A configurable circuit breaker adaptable to any of plural structural setups includes three independent poles, each pole comprising an interconnection of:

an incoming conductive point and an outgoing conductive point;

at least one vertical slot;

a clamp for mounting the circuit breaker;

at least one mounting insert connected with the clamp;

a movable link for actuation of the circuit breaker;

a side panel;

an epoxy frame for mounting the circuit breaker on a cassette or truck horizontally or vertically; and at least one conducting stub configured to fit a tulip contact.

2. A configurable circuit breaker of claim 1, comprising:

conductive arms connected with the incoming and outgoing conduction points, respectively, wherein arm distances and pole distances are adjustable, including a distance between the incoming conductive point and the outgoing conductive point.

3. A configurable circuit breaker of claim 1, wherein the poles can be adjustably affixed, in both vertical and horizontal directions, via the clamp and the slot respectively.

4. A configurable circuit breaker of claim 1, wherein the at least one mounting insert is housed along a back and the base of the poles to provide flexible mounting options to suit plural space, magnetic and/or electric constraints.

5. A configurable circuit breaker of claim 1, wherein the at least one mounting insert is used to mount the poles, vertically or horizontally.

6. A configurable circuit breaker of claim 1, wherein the movable link is configured to connect the poles of the circuit breaker to a common shaft.

7. A configurable circuit breaker of claim 1, wherein the movable link is configured to connect the poles, which are electrically or electronically coupled to a common shaft.

8. A configurable circuit breaker of claim 1, wherein the side panel covers at least a portion of an interior of the circuit breaker for positioning the circuit breaker per a desired configuration.

9. A configurable circuit breaker of claim 1, wherein the epoxy frame protects internals of the poles from environmental factors including voltage isolation, dust and heat, and serves as a framework for mounting the circuit breaker.

10. A configurable circuit breaker of claim 1, comprising:

a mechanism for mounting the circuit breaker and for bearing the load of the circuit breaker.

11. A configurable circuit breaker of claim 1, comprising:

at least one stub configured for a tulip contact, which can be accessed by removing the side-panel such that the at least one conducting stub is used to mount an incoming conductor or an outgoing conductor on the circuit breaker, said conducting stub being part of a contactor which is movable in the vertical slot.

12. A configurable circuit breaker of claim 3, wherein the slot is fitted with a vertical drape.

13. A configurable circuit breaker of claim 1, comprising:

a common magnetic or spring actuator mounted on any of the poles or to the truck or cassette to suit a plurality of space, magnetic and/or electric constraints.

14. A configurable circuit breaker of claim 1, comprising:

a magnetic or spring actuator mounted on each of the poles to suit a plurality of space, magnetic and/or electric constraints.

15. A configurable circuit breaker according to claim 10, wherein the mechanism for mounting includes at least one mounting insert in each pole.

16. A configurable circuit breaker according to claim 15, wherein the mechanism for mounting includes a mounting insert in a common actuator associated with the three independent poles.

* * * * *